US005517216A

United States Patent [19]

Stamer et al.

[11] Patent Number: 5,517,216

[45] Date of Patent: May 14, 1996

[54] INK JET PRINTER EMPLOYING TIME OF FLIGHT CONTROL SYSTEM FOR INK JET PRINTERS

[75] Inventors: Michael E. Stamer, Lincolnwood; George Arway, Norridge, both of Ill.

[73] Assignee: Videojet Systems International, Inc., Wooddale, Ill.

[21] Appl. No.: 920,797

[22] Filed: Jul. 28, 1992

[51] Int. Cl.[6] ..... B41J 29/38

[52] U.S. Cl. ..... 347/6; 347/78

[58] Field of Search ..... 347/6, 75, 78–81

[56] References Cited

U.S. PATENT DOCUMENTS

| | | | |
|---|---|---|---|
| 3,787,882 | 1/1974 | Fillmore et al. | 347/78 X |
| 4,217,594 | 8/1980 | Meece et al. | 347/6 |
| 4,281,332 | 7/1981 | Horike | 347/6 |
| 4,417,256 | 11/1983 | Fillmore et al. | 347/78 |
| 4,521,789 | 6/1985 | Jinnai . | |
| 4,535,339 | 8/1985 | Horike et al. | 347/6 |
| 4,542,385 | 9/1985 | Jinnai | 347/78 |
| 4,555,712 | 11/1985 | Arway et al. | 347/7 |
| 4,590,483 | 5/1986 | Regnault et al. | 347/6 |
| 4,797,688 | 1/1989 | Furukawa | 347/6 |
| 4,827,278 | 5/1989 | Lecheheb | 347/7 |
| 4,827,280 | 5/1989 | Stamer et al. | 347/6 |
| 5,160,939 | 11/1992 | Bajeux et al. | 347/6 X |
| 5,396,273 | 3/1995 | Stamer | 347/78 |
| 5,418,557 | 5/1995 | Pullen | 347/7 |
| 5,420,624 | 5/1995 | Braun et al. | 347/79 X |

FOREIGN PATENT DOCUMENTS

| | | | |
|---|---|---|---|
| 8903768 | 5/1989 | European Pat. Off. . | |
| 2750303 | 5/1978 | Germany | 346/6 |
| 56-113463 | 7/1981 | Japan . | |
| 58-199163 | 11/1983 | Japan | 347/80 |
| 58-199164 | 11/1983 | Japan | 347/80 |
| 59-62156 | 4/1984 | Japan . | |
| 60-255443 | 12/1985 | Japan . | |
| 60-255442 | 12/1985 | Japan . | |
| 61-227060 | 10/1986 | Japan . | |
| 62-282940 | 12/1987 | Japan | 347/6 |
| 63-79034 | 4/1988 | Japan . | |
| 2250235 | 3/1992 | United Kingdom . | |

OTHER PUBLICATIONS

Simulatation of a Nonlinear Fluid System Servo For Drop Flighttime Control in an Ink Jet Printer, S. Ghose, pp. 385–388.

Heuft–Jet Printer Manual.

*Primary Examiner*—Arthur T. Grimley
*Assistant Examiner*—Shuk Y. Lee
*Attorney, Agent, or Firm*—Rockey, Rifkin and Ryther

[57] ABSTRACT

Flight time of a stream of ink drops is measured and compared against a set point to determine variations therefrom. Variations due to changes in the ink composition are compensated for by adding or withholding solvent in proportion to the detected change. Changes due to variations in nozzle drive voltage result in the computation and use of a new flight time set point value, if necessary to avoid erroneous corrective action.

2 Claims, 5 Drawing Sheets

INK JET PRINTER EMPLOYING TIME OF FLIGHT CONTROL SYSTEM FOR INK JET PRINTERS

BACKGROUND OF THE INVENTION

This invention relates to control systems for ink jet printers. More specifically, it relates to a time of flight based control system in which the ink drops issuing from the print head are monitored to detect changes in flight time due to various causes.

In ink jet printers it is known that changes in ink composition occur over time and if not compensated, result in a deterioration of print quality or shut down of the printer. For this reason, it is common to monitor the ink in such systems. In continuous jet printers, ink is recirculated until it is printed onto a substrate. Because the ink contains volatile substances (solvents) it will thicken over time as these evaporate resulting in changes in ink composition.

In U.S. Pat. Nos. 4,555,712, and 4,827,280 assigned to the present assignee, the flow rate of the ink from the ink supply system to the nozzle is monitored. In such devices, ink passes through a small cylindrical tank having float switches therein. The time required for the ink level to drop from a first point to a second point is monitored and changes are indicative of changes in ink composition. Detected changes are compensated for in any of several ways including changing the ink temperature, changing the pressure applied to the ink, adding or withholding solvent. For example, in the '712 patent, solvent is either added or not (go/no go) in a predetermined quantity. In the '280 patent, a solvent add valve is operated for a period proportional to the error in flow time (servo control).

Flow rate control works satisfactorily but there are certain disadvantages associated therewith. These include errors and uncertainties due to the inaccuracy of the float switches, the need for a separate measurement tank.

For these and other reasons, it has been suggested to monitor the ink stream by measuring the flight time of the droplets as they break off from the ink stream, after exiting the nozzle. Time of flight is related to flow rate, but measurement thereof can be accomplished without electromechanical float switches, separate tanks and the associated problems.

It is known in the prior art to measure drop flight time. For example, the patent to Meece U.S. Pat. No. 4,217,594 controls drop velocity as a function of temperature variation. The patent to Horike U.S. Pat. No. 4,535,339 measures flight velocity and adjusts pressure to maintain velocity at a target value. Finally, Linx European Publication No. WO89/03768 discloses a control system for maintaining constant flight time. Flight time is monitored and the pressure is adjusted, as necessary, to maintain flight time constant. If the required pressure increase exceeds a preset value, solvent is added to decrease ink viscosity, using a fixed value time (predetermined quantity).

Although time of flight monitoring has been used for ink jet printers there are certain factors which complicate matters. When a printer is placed into operation it is often the case that the user will manually adjust or "fine-tune" the nozzle drive voltage to maximize print quality. Such adjustments may also be periodically performed while the printer is on line. As will be apparent to those skilled in the art, such adjustments may materially affect flight time and/or the measurement of flight time and may cause a control system to improperly alter operating pressure and/or ink composition causing print quality to deteriorate. If the operator tries to compensate by further adjustments to the nozzle drive, a degenerative condition can occur eventually requiring printer shut down to re-establish correct operating conditions.

Accordingly, it is desirable to provide a more sophisticated time of flight control system which can determine the nature of a change in flight time and compensate correctly depending upon the reason for such change.

It is another object of the present invention to provide such an improved time of flight control system for an ink jet printer.

It is another object of the invention to provide a time of flight control system which will maintain ink composition relatively stable and adjust time of flight set point when necessary due to nozzle drive voltage adjustments.

These and other objects of the invention will be apparent from the remaining portion of the specification.

DETAILED DESCRIPTION

As indicated in the background section, measurement of flow rate of the ink from an ink supply system to a printhead is important in order to maintain ink quality over extended periods of printer operation. As ink thickens, due to loss of solvent, changes in temperature or other reasons, it is necessary to adjust the ink. Flow rate measurements, for this purpose, as disclosed for example in prior U.S. Pat. Nos. 4,555,712 and 4,827,280 require a small cylindrical tank having float switches therein. The time required for the fluid to flow from an upper float switch to a lower float switch is a direct measurement of float rate and can be used to adjust ink composition. Such a system, however, requires the aforementioned separate cylindrical tank and a fill cycle to permit this type of measurement.

Figure 1:
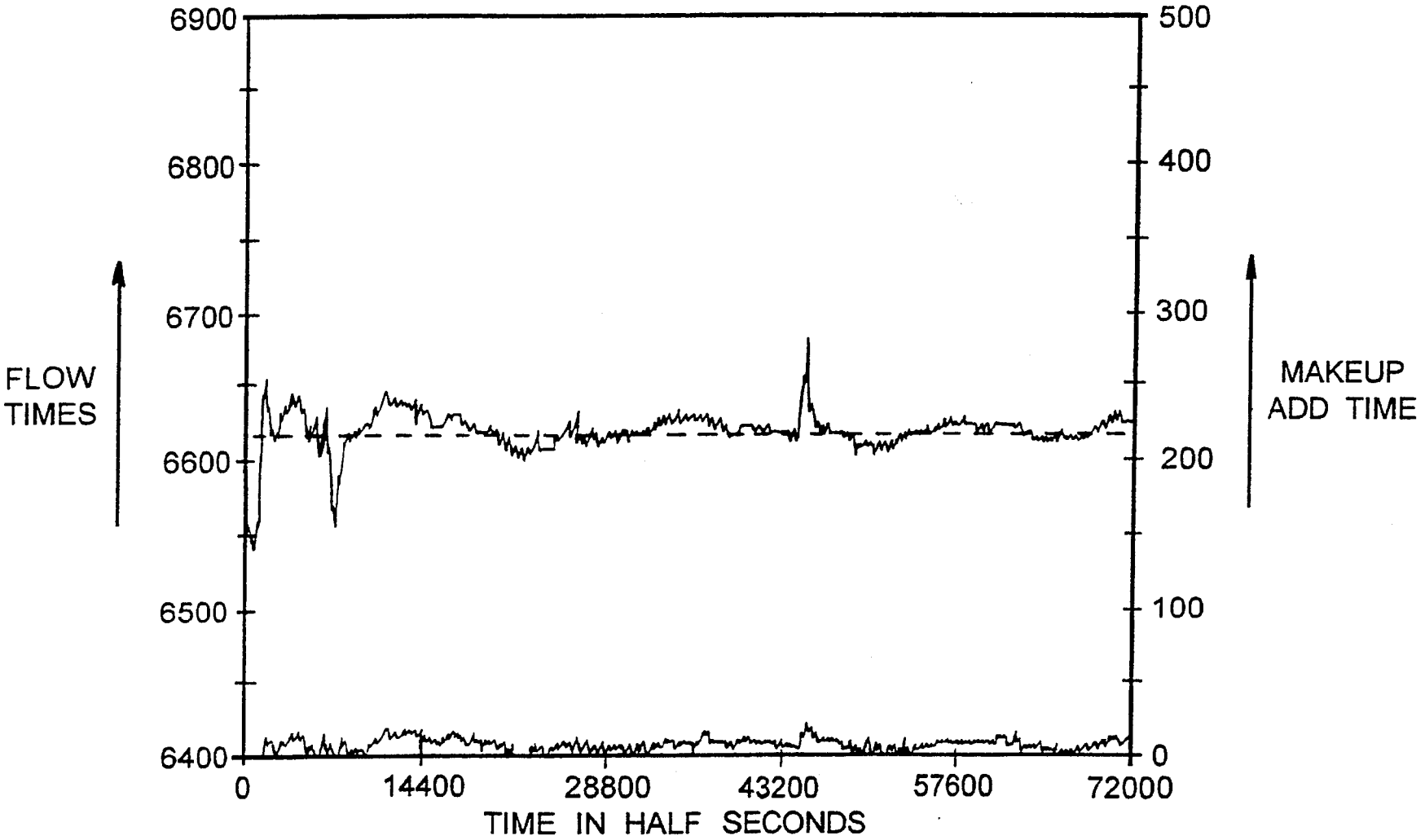
FIG. 1 PRIOR ART
FIG. 1 is a diagram illustrating the operation of a flow time control system according to the prior art.

Recently, electrical pumps have been employed for pressurizing the ink, eliminating pneumatic pump cycles. In addition, noise is introduced into the flow rate measurement by the less than perfect operation of the float switches. FIG. 1 provides an illustration of a flow rate measuring system having "improved float switches". Even so, it can be seen that there is a substantial amount of noise, due primarily to the operation of the float switches.

According to the present invention, the time of flight of drops which separate from the stream after ejection from the nozzle is measured. Time of flight is, of course, related to flow time and thus this information may also be used to control ink composition. The advantages of time of flight measurement include the ability to operate with electric pump systems, the elimination of the need for separate cylindrical tanks and the avoidance of float noise associated with float switches.

Figure 2:
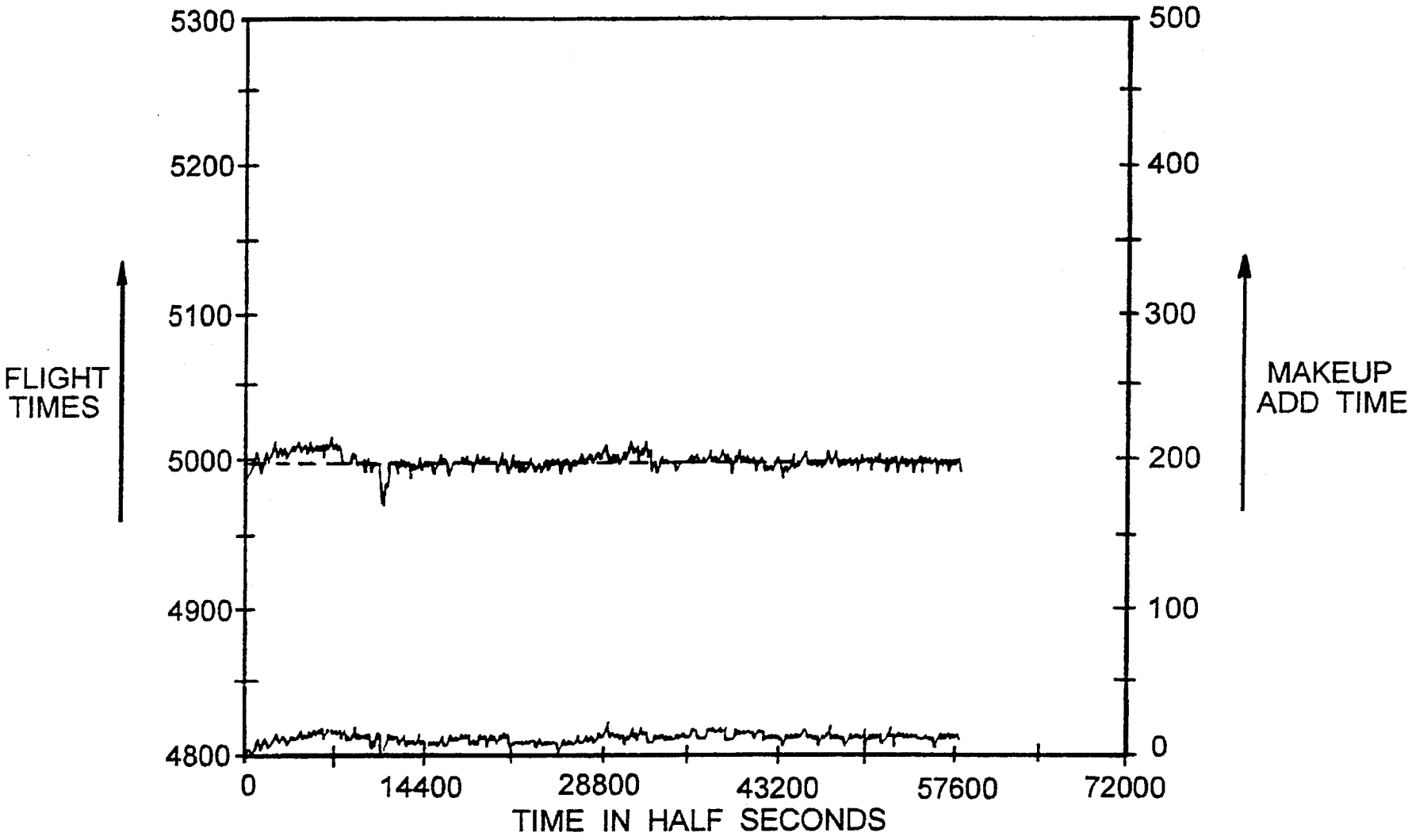
FIG. 2 illustrates a time of flight control system according to the present invention.

FIG. 2 illustrates operation of a time of flight based control system according to the invention wherein the ink is pressurized using an electrical pump. Note the significantly improved quality of the signal due to the reduced noise component.

Referring to FIGS. 3A–3D, there are illustrated printhead setups suitable for use with the present invention. In each figure a nozzle 20 of known orifice size is used to eject a solid ink stream 22 past a charge tunnel 24 to a catcher 26. As well known by those skilled in this art, the nozzle has applied thereto a stimulation voltage or nozzle drive of a known amplitude and frequency. This results in the ink stream breaking up into a stream of droplets within the charge tunnel electrode structure. Selected droplets are given an electric charge and are deflected away from the catcher by a deflection electrode (not shown for purposes of clarity).

Figures 3A, 3B, 3C, 3D:
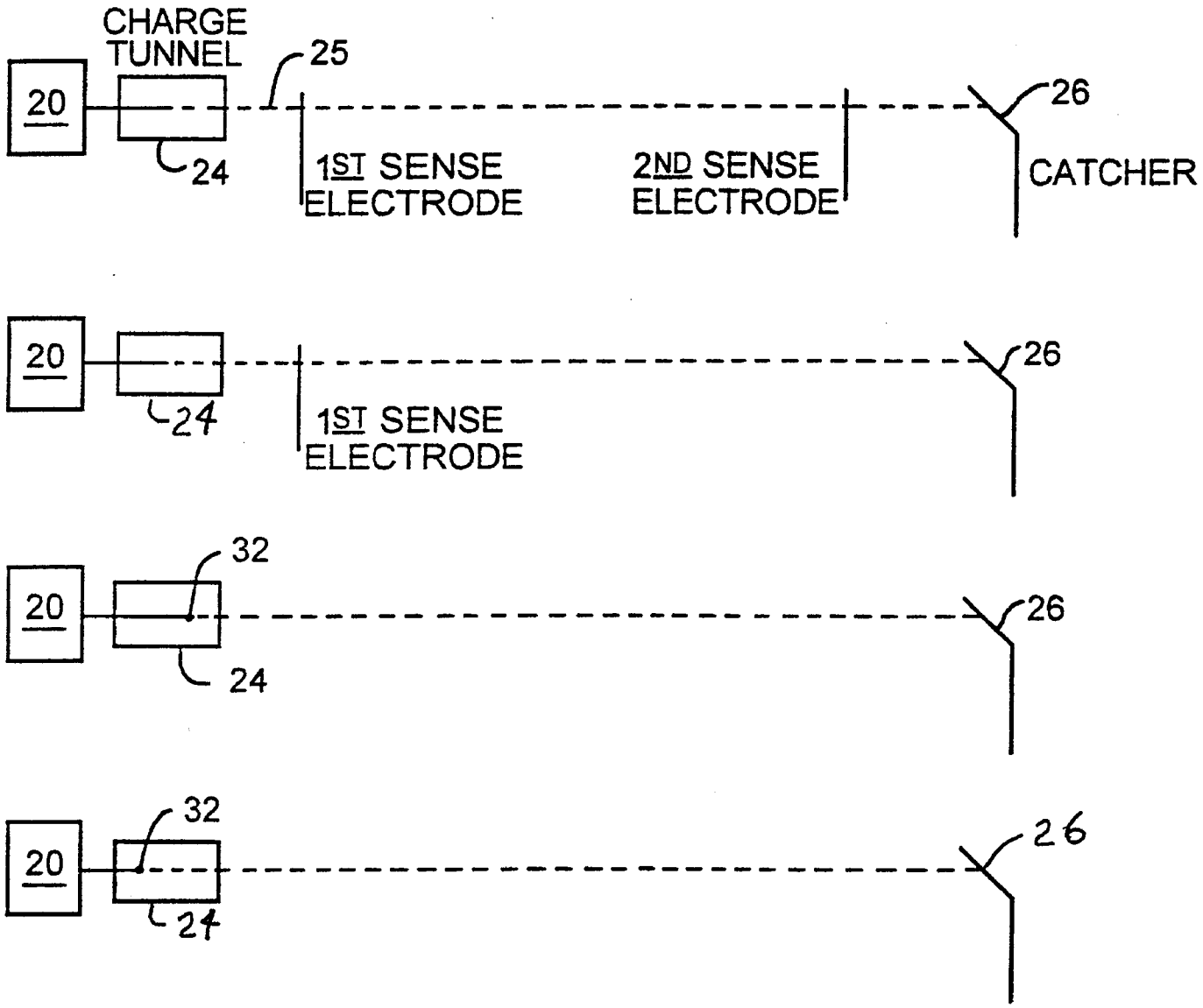
FIGS. 3A, 3B, 3C and 3D illustrate various printer configurations for use with the present invention.

In the embodiment of FIG. 3A, two sensing electrodes 28 and 30 are provided along the flight path of the ink droplets 25. Time of flight measurements can be made of one or more drops in succession. The sensing electrodes 28 and 30 are located along the drop flight path in close proximity to the stream. As a charge drop passes an electrode, it produces an electrical impulse. The time between the first and second pulses is the flight time. Such a measurement can be conducted during a setup mode as well as during actual operation of the printer. Flight time can be measured on a regular basis for example, at about four second intervals and an average of several readings taken to determine a value to be used for further operation of the control system. Of course, the number of measurements per unit time will vary depending upon the particular printer system to which the invention is adapted.

FIG. 3B shows a modified arrangement according to the present invention. Everything is identical except for the elimination of the second electrode 30. Instead, the catcher functions as the second electrode. In this embodiment the test drops are provided with very small electrical charges and thus they are not deflected from the catcher. As with the first embodiment the time a test drop takes to pass from the first electrode to the catcher is a measure of the flight time and hence the flow rate of the ink.

FIGS. 3C and 3D illustrate a third embodiment of the invention in which the charge tunnel 24 functions as the first electrode while the catcher 26 functions as the second electrode. As will be apparent in this embodiment, no separate electrodes are required to measure the time of flight. The third embodiment does cause a complication, however, where changes in nozzle drive occur. By comparing FIGS. 3C and 3D, it will be seen that the drop break-off point 32 has changed within the charge tunnel. In this embodiment, the charge signal applied at the charge tunnel starts the time measurement and the impulse sensed by the catcher ends the time measurement. If nozzle drive level is changed in such a system, the break-off point 32 will move as illustrated. This results in a change in flight time unrelated to a change in ink viscosity or temperature. If no compensation is provided, the control system would improperly adjust the ink composition as a result of the variation in flight time due to a change in nozzle drive.

According to the present invention, the control system is operated in a manner to minimize changes in ink composition occasioned by changes in nozzle drive when using the embodiment of FIGS. 3C and 3D.

Figure 4:
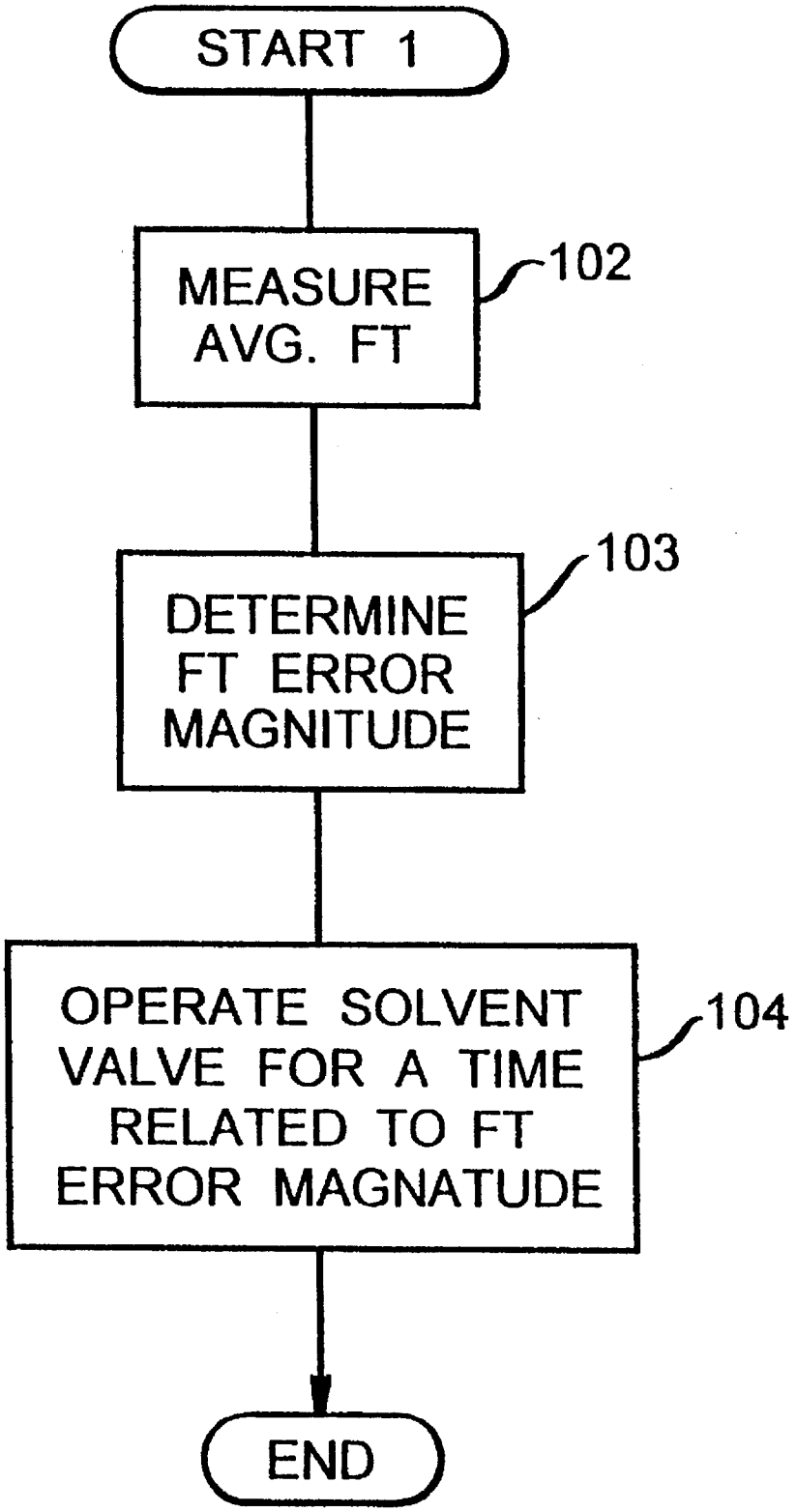
FIGS. 4 and 5 are flow diagrams useful in understanding the operation of the system according to the present invention.
Figure 5:
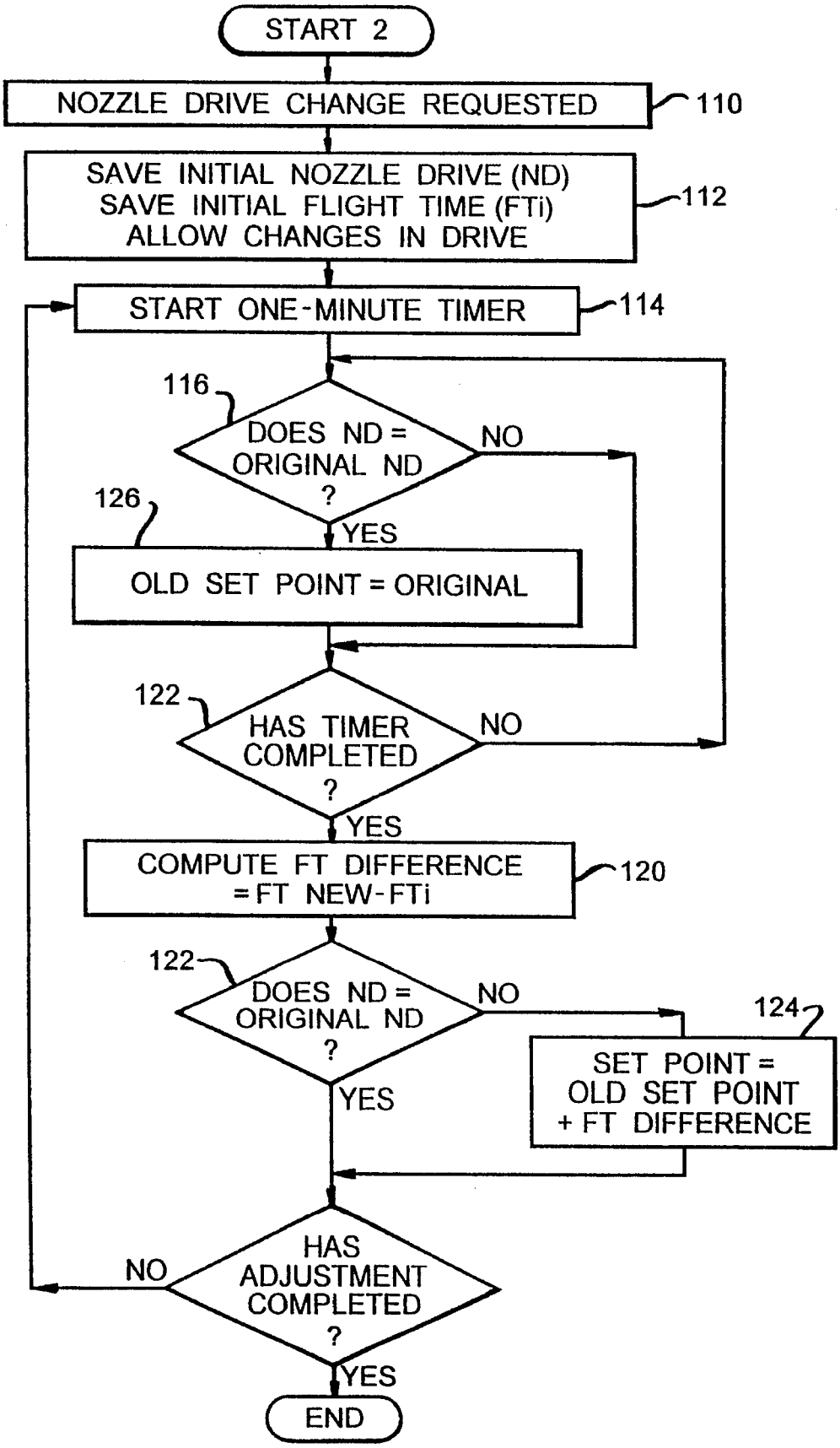

Referring now to FIGS. 4 and 5, the operation of the controller associated with the ink jet printer is indicated. It is known to those skilled in the art that virtually all ink jet printers employ a microprocessor or similar controller for operation. Such devices have a memory for storing a control program and various information concerning font sizes and drop placement. FIGS. 4 and 5 are flow diagrams indicating the functions which such a control program would perform in order to implement the present invention.

In FIG. 4, the control program periodically, say every 1–3 minutes, processes an average of recent flight time measurements, step 102. At step 103, the magnitude of the error is determined. At step 104, the solvent add valve is operated for a period of time related to the magnitude of the error. A preferred relation between error and valve on time is disclosed in U.S. Pat. No. 4,827,280, hereby incorporated by reference. In particular, FIGS. 8A–8D and the text relating thereto disclose a proportional control scheme suitable for use with the present invention. Subsequent flight time measurements should indicate that the flight time begins to approach the set point due to such modification in ink composition..

Referring to FIG. 5, an optional flow diagram employed when a change in nozzle drive voltage is requested is illustrated for the FIGS. 3C and 3D embodiment. A change in nozzle drive will occur when an operator adjusts the amplitude of the voltage in an effort to optimize print quality. Changing nozzle drive will change flight time as measured by the sensors in the FIGS. 3C and 3D embodiment. If no compensating action is taken, the ink control program of FIG. 4 would respond as though ink viscosity had changed.

According to the present invention, the control system compensates for nozzle drive changes by keeping track of flight time before and after the nozzle drive change. Provided that the elapsed time of the drive adjustment is short (for example, on the order of one or two minutes), any concurrent change in flight time due to viscosity change can be neglected. That being the case, any detected change in flight time is due to nozzle drive adjustment and its magnitude added to the original set point flight time to generate a revised set point.

In describing the operation of FIG. 5, it is assumed that the original flight time set point and nozzle drive have been determined at the time the printer is set up using a fresh supply of ink. Referring to FIG. 5, step 110, when a nozzle drive change is requested, the initial nozzle drive value is saved along with the initial flight time, step 112. Changes in nozzle drive voltage are then permitted.

After changes are enabled, a timer is started, step 114 which may be on the order of one or two minutes depending upon the system. A check is made at 116 to determine if nozzle drive equals the original nozzle drive. If not, a check is made to determine if the timer of step 114 has timed out (step 118). If not, the program repeatedly loops back to step 116 until the timer has timed out. At that point, if the nozzle drive is not equal to the original value, it is desired to change the flight time set point. At step 120 the difference in flight time is computed and the program branches, via step 122, to step 124 where the set point is set equal to the original set point plus the flight time difference. Assuming no further nozzle drive adjustments are made, the routine ends.

Additional functions are provided in FIG. 5 in recognition of the fact that a system which permits changes to its set point is subject to long term drift. Accordingly, the original set up flight time reference, determined with fresh ink for a particular nozzle drive is remembered. If that drive level is again utilized, then the reference flight time corresponding thereto is reestablished when computing further set point changes. For that purpose, a check is made at 116 to determine if current nozzle drive equals the original value. If so, the program branches to 126 where the set point flight time is set equal to its original value. The program then continues at steps 118 through 122 as previously explained.

From the foregoing it will be seen that the present invention permits monitoring of flight time thereby to determine changes in flow rate of the ink to modify ink composition when necessary. In the case of nozzle drive adjustment to the embodiment of FIGS. 3C and 3D, the flight time set point is altered avoiding erroneous adjustments to ink composition.

While preferred embodiments of the present invention have been illustrated and described, it will be understood by those of ordinary skill in the art that changes and modifications can be made without departing from the invention in its broader aspects. Various features of the present invention are set forth in the following claims.

What is claimed:

1. In an ink jet printer including a nozzle having an opening therein, means for supplying a stream of ink having a viscosity to said nozzle under pressure for projection toward a surface to be marked, means for applying a stimulation voltage of a selected amplitude to said nozzle to cause the ink stream to breakup into discrete drops, a charge tunnel for electrically charging selected ones of said drops and means for controlling said printer including the stimulation voltage applying means, the improvement comprising:

a) means for measuring flight time of selected ink drops, said means including a catcher for receiving uncharged or weakly charged drops and an electrode associated with said catcher, the time between a weakly charged drop leaving said charge tunnel and being detected by said catcher electrode constituting the flight time measurement;

b) said means for controlling including means responsive to said measuring means for: (i) periodically comparing the measured flight time against a reference value to determine variations therefrom; (ii) adjusting the viscosity of said ink responsive to the determined variation in flight time; and (iii) altering said reference value in the event of a change in stimulation voltage amplitude to prevent erroneous adjustments to ink viscosity.

2. A method of operating an ink jet printer including a nozzle having an opening therein, means for supplying a stream of ink having a viscosity to said nozzle under pressure for projection toward a surface to be marked, means for applying a stimulation voltage of a selected amplitude to said nozzle to cause the ink stream to breakup into discrete drops, a charge tunnel for electrically charging selected ones of said drops, means for controlling said printer including the stimulation voltage applying means and a catcher for receiving uncharged or weakly charged drops, said catcher including an electrode associated therewith, said method comprising the steps of:

a) measuring a flight time of selected drops between said charge tunnel and said catcher electrode;

b) periodically comparing the measured flight time with a reference value to determine variations therefrom;

c) adjusting the viscosity of said ink in response to detecting a variation in flight time from said reference value by an amount related to the variation in flight time;

d) altering said reference value in the event of a change in stimulation voltage amplitude to prevent erroneous adjustments to ink viscosity.

* * * * *